US007905486B2

(12) United States Patent
Abe

(10) Patent No.: US 7,905,486 B2
(45) Date of Patent: Mar. 15, 2011

(54) TRANSPORTATION APPARATUS FOR TRANSPORTING TRANSPORTATION TARGET MEDIUM, RECORDING APPARATUS HAVING THE SAME, AND CONTROL METHOD FOR CONTROLLING THE SAME

(75) Inventor: Takahiro Abe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 506 days.

(21) Appl. No.: 11/939,331

(22) Filed: Nov. 13, 2007

(65) Prior Publication Data

US 2008/0111298 A1 May 15, 2008

(30) Foreign Application Priority Data

Nov. 14, 2006 (JP) ..... 2006-308383

(51) Int. Cl.
*B65H 5/02* (2006.01)

(52) U.S. Cl. ..... 271/274; 271/273

(58) Field of Classification Search ..... 271/273, 271/274

See application file for complete search history.

(56) References Cited

U.S. PATENT DOCUMENTS

| | | | | |
|---|---|---|---|---|
| 4,555,104 | A * | 11/1985 | Fukuju et al. | 271/228 |
| 5,204,724 | A * | 4/1993 | Nakabayashi et al. | 399/361 |
| 6,209,861 | B1 * | 4/2001 | Kakuta et al. | 271/3.02 |
| 6,435,084 | B1 * | 8/2002 | Suzuki | 101/118 |
| 7,575,233 | B2 * | 8/2009 | Tanaami | 271/273 |
| 2004/0164487 | A1 * | 8/2004 | Kakigi | 271/291 |
| 2004/0207708 | A1 * | 10/2004 | Ohashi et al. | 347/104 |

FOREIGN PATENT DOCUMENTS

| | | |
|---|---|---|
| JP | 2000-143035 | 5/2000 |
| JP | 2002-128314 | 5/2002 |
| JP | 2002-192782 | 7/2002 |
| JP | 2005-022242 | 1/2005 |
| JP | 2006-056644 | 3/2006 |

* cited by examiner

*Primary Examiner* — Stefanos Karmis
*Assistant Examiner* — Howard Sanders
(74) *Attorney, Agent, or Firm* — Workman Nydegger

(57) ABSTRACT

The invention provides a transportation apparatus for transporting a transportation target medium in a predetermined transportation direction. The transportation target medium transportation apparatus according to an aspect of the invention includes: a transport driving roller that is operated rotationally; a transport driven roller that is urged against the transport driving roller and follows the rotary movement of the transport driving roller; and a control unit that controls the movement of the transport driven roller between a contact position at which the transport driven roller is in contact with the transport driving roller and a non-contact position at which the transport driven roller is not in contact with the transport driving roller. In such a configuration of the transportation target medium transportation apparatus, the control unit moves the transport driven roller to the non-contact position at which the transport driven roller is not in contact with the transport driving roller when the thickness of the transportation target medium is at least a predetermined value, and then moves the transport driven roller to the contact position at which the transport driven roller is in contact with the transport driving roller when the length of time period in which the transport driven roller continues to be at the non-contact position exceeds a predetermined time period.

6 Claims, 10 Drawing Sheets

TRANSPORTATION APPARATUS FOR TRANSPORTING TRANSPORTATION TARGET MEDIUM, RECORDING APPARATUS HAVING THE SAME, AND CONTROL METHOD FOR CONTROLLING THE SAME

BACKGROUND

1. Technical Field

The present invention generally relates to a transportation apparatus for transporting a transportation target medium, a recording apparatus that is provided with the transportation apparatus for transporting a transportation target medium, and a control method for controlling the transportation apparatus for transporting a transportation target medium. More particularly, the present invention relates to a transportation apparatus for transporting a sheet-type transportation target medium while holding it between a pair of pinching rollers thereof during transportation. The present invention further relates to a recording apparatus that is provided with such a transportation apparatus, and a control method for controlling such a transportation apparatus.

2. Related Art

In the related technical fields of the invention, transportation units are built in a variety of apparatuses/equipment such as a recording apparatus, a facsimile machine, and a copying machine, though not limited thereto, for the functional purpose of transporting sheet-shaped transportation target media, sheet-shaped recording target media, or the like. As an example of these transportation units, one known in the art is configured to transport a transportation target medium while holding it between a pair of pinching rollers of the transportation apparatus during transportation, at least one of which is/are driven in a rotational manner. Such a type of transportation unit has a driving roller that is operated rotationally (i.e., rotates actively) and a driven roller that follows the rotary movement of the driving roller (i.e., rotates passively). In such a configuration, the driven roller applies a pressing force onto a transportation target medium toward the driving roller. As the driving roller rotates, the transportation target medium is transported while being pinched therebetween.

The patent document JP-A-2002-128314 discloses a paper transportation apparatus that has a driving roller and a driven roller that is urged toward the driving roller. The paper transportation apparatus described in JP-A-2002-128314 transports a sheet of paper in accordance with the rotation of the driving roller. During transportation, the sheet of paper is supported between the driving roller and the driven roller. In addition to these rollers, the paper transportation apparatus according to JP-A-2002-128314 is further provided with an urging member that urges the driven roller toward the driving roller and an arm member that allows the driven roller to move apart from the driving roller against the urging force applied thereto by the urging member. With such a configuration, it is possible to remove, if there occurs any paper jam malfunction between the driving roller and the driven roller, a jammed paper by releasing the pinching force exerted by the driven roller without causing any adverse mechanical stress on each of these rollers.

The patent document JP-A-2002-192782 teaches a configuration in which, at an ejection unit of a recording apparatus that is a kind of transportation apparatus, a holder that is configured to be capable of moving in a rotating direction (i.e., drawing/tracing an arc) supports an ejection driven roller. With such a configuration, it is possible to prevent a recording target material/medium from being damaged by moving the ejection driven roller apart from an ejection driving roller. As described above, some of transportation apparatuses that have a pair of pinching rollers provided for transportation of a transportation target medium allow a driving roller and a driven roller to become distanced from (i.e., not in contact with) each other when there is no transportation target medium that is now being transported.

A related-art transportation unit such as one described above transports various kinds of sheet-type recording target media that vary in terms of thickness from one to another. Nowadays, it is not infrequent that, in addition to a sheet of recording paper having a thickness of less than 1 mm, which is flexible, a sheet of cardboard paper, information recording medium, printed wiring board, and the like having a thickness of 3 mm of greater is fed as a target of transportation. In a related-art application where a transportation unit having the roller mechanism described above transports such a thick-type recording target medium, as a pre-transportation step, a driven roller is temporarily moved apart from a driving roller so as to form a sufficiently large clearance therebetween; and thereafter, the thick recording target medium is fed therebetween. With such a procedure/configuration, the related-art transportation unit described above ensures the smooth feeding of the recording target medium. In addition, the above-described procedure/configuration makes it possible to reduce any undesirable mechanical stress applied to constituent members that make up the transportation unit.

In the roller configuration of the above-described transportation apparatus that has a combination of the driving roller and the driven roller, it is preferable that the driven roller can rotate smoothly as the driving roller rotates. In order to ensure the smooth rotation of the driven roller, an urging force is not directly applied to the driven roller but indirectly thereto via a driven roller holder. The driven roller holder supports the driven roller in such a manner that the driven roller can rotate freely. For the same reason, when the driven roller is moved apart from the driving roller, it is done so by means of the driven roller holder.

When the driven roller holder is turned so as to move the driven roller apart from the driving roller, the mechanical stress due to the urging force is applied to the driven roller holder. Disadvantageously, plastic deformation could occur on the driven roller holder, most of which is made of a resin material, if the driven roller continues to be distanced apart from the driving roller for a long time period. As a result of the plastic deformation of the driven roller holder, a gap between the driving roller and the driven roller decreases. Eventually, the gap therebetween decreases into an insufficient level. If the gap between the driving roller and the driven roller is set at a larger value in anticipation of such plastic deformation of the driven roller holder, a wide open space is required in the periphery of the driven roller holder because the moving vector amount of the driven roller becomes larger. For this reason, disadvantageously, the size of a transportation apparatus increases. On the other hand, an expensive deformation-free material must be used in order to avoid the driven roller holder from becoming deformed. Or, it is necessary to increase the size of the driven roller holder itself for the prevention of plastic deformation thereof, which results in an undesirable increase in the size of the transportation apparatus.

SUMMARY

In order to address the above-identified problem without any limitation thereto, an advantage of a first aspect of the invention is to provide a transportation apparatus for transporting a transportation target medium in a predetermined transportation direction, the transportation target medium transportation apparatus including: a transport driving roller that is operated rotationally; a transport driven roller that is urged against the transport driving roller and follows the rotary movement of the transport driving roller; and a control section that controls the movement of the transport driven roller between a contact position at which the transport driven roller is in contact with the transport driving roller and a non-contact position at which the transport driven roller is not in contact with the transport driving roller, wherein the control section moves the transport driven roller to the non-contact position at which the transport driven roller is not in contact with the transport driving roller when the thickness of the transportation target medium is at least a predetermined value, and then moves the transport driven roller to the contact position at which the transport driven roller is in contact with the transport driving roller when the length of time period in which the transport driven roller continues to be at the non-contact position exceeds a predetermined time period. With the configuration described above, it is possible to prevent the occurrence of plastic deformation of a driven roller holder, which could be caused when the transport driven roller continues to be distanced apart from the transport driving roller for a long time period. In other words, it is possible to manufacture the driven roller holder having a compact configuration by means of low-cost material without any necessity to increase the mechanical strength thereof at the sacrifice of size and/or cost. In addition, since it is not necessary to anticipate any decrease in a gap between the transport driving roller and the transport driven roller due to plastic deformation, it is possible to reduce both the moving vector amount of the driven roller and a space required for moving thereof, which advantageously results in the smaller size of the transportation apparatus.

In the configuration of the transportation target medium transportation apparatus according to the first aspect of the invention described above, it is preferable that the control section issues a message for notifying to a user that, in a case where the transport driven roller has been moved to the contact position at which the transport driven roller is in contact with the transport driving roller when the length of time period in which the transport driven roller continues to be at the non-contact position exceeds the predetermined time period, the moving of the transport driven roller to the contact position has been completed; and the control section causes the transport driven roller to stay at the contact position till the reception of the issued message by the user is confirmed. With the configuration described above, the user is notified that the transport driven roller is now in contact with the transport driving roller, and that, for this reason, it is not possible to feed a thick-type recording target medium unless it is moved apart therefrom.

In the configuration of the transportation target medium transportation apparatus according to the first aspect of the invention described above, it is preferable that the control section makes a detection as to whether a transportation target medium is present between the transport driving roller and the transport driven roller or not, and issues a message so as to alert the user to remove, if present, the transportation target medium therefrom. With the configuration described above, it is possible to prevent the transportation target medium from remaining not removed between the transport driving roller and the transport driven roller that are not currently in operation.

In the configuration of the transportation target medium transportation apparatus according to the first aspect of the invention described above, it is preferable that the control section moves the transport driven roller to a position corresponding to a recording target medium that is most likely to be fed in the next operation in a case where the transport driven roller has been moved to the contact position at which the transport driven roller is in contact with the transport driving roller when the length of time period in which the transport driven roller continues to be at the non-contact position exceeds the predetermined time period and further in a case where it is detected that no transportation target medium is present between the transport driving roller and the transport driven roller. With the configuration described above, it is possible to initiate the next operation of the transportation target medium transportation apparatus in a speedy manner.

As another advantage of the invention, the invention provides a recording apparatus having a recording head for forming an image on the surface of a recording target medium, the recording apparatus being provided with the transportation target medium transportation apparatus having the configuration according to the first aspect of the invention. With the configuration described above, it is possible to offer the advantageous effects described above in the transport unit of the recording apparatus.

In order to address the above-identified problem without any limitation thereto, the invention provides, as a second aspect thereof, a control method for controlling a transportation apparatus for transporting a transportation target medium in a predetermined transportation direction, the transportation target medium transportation apparatus having a transport driving roller that is operated rotationally and further having a transport driven roller that is urged against the transport driving roller and follows the rotary movement of the transport driving roller, the transportation target medium transportation apparatus being configured so as to be able to control the movement of the transport driven roller between a contact position at which the transport driven roller is in contact with the transport driving roller and a non-contact position at which the transport driven roller is not in contact with the transport driving roller, the control method for controlling the transportation target medium transportation apparatus including: moving the transport driven roller to the non-contact position at which the transport driven roller is not in contact with the transport driving roller when the thickness of the transportation target medium is at least a predetermined value; and moving the transport driven roller to the contact position at which the transport driven roller is in contact with the transport driving roller when the length of time period in which the transport driven roller continues to be at the non-contact position exceeds a predetermined time period. The control method described above offers the advantageous effects described above without any restriction to hardware configuration.

In order to address the above-identified problem without any limitation thereto, the invention provides, as a third aspect thereof, a transportation apparatus for transporting a transportation target medium in a predetermined transportation direction, the transportation target medium transportation apparatus including: a transport driving roller that is operated rotationally; a transport driven roller that is urged against the transport driving roller and follows the rotary movement of the transport driving roller; and a control section that selectively controls the movement of the transport driven roller between a contact position at which the transport driven roller is in contact with the transport driving roller and a non-contact position at which the transport driven roller is not in contact with the transport driving roller depending on the thickness of the transportation target medium, wherein the control section moves the transport driven roller to the contact position at which the transport driven roller is in contact with the transport driving roller when the length of time period in which the transport driven roller continues to be at the non-contact position exceeds a predetermined time period. With such a configuration, the transportation apparatus described above offers the advantageous effects described above.

It should be noted that the above summary of the invention does not enumerate all features necessary for the implementation of the invention; and thus, needless to say, any subcombination of these features could also constitute the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Although the invention is described below while explaining an exemplary embodiment thereof, the specific embodiment described below is not intended to limit the scope of the invention recited in the appended claims and thus should in no case be understood to restrict thereof; nor is it always necessary to encompass all of features and/or a combination(s) thereof that are discussed in the following embodiment as means for solving the problem identified by the invention.

Figure 1:
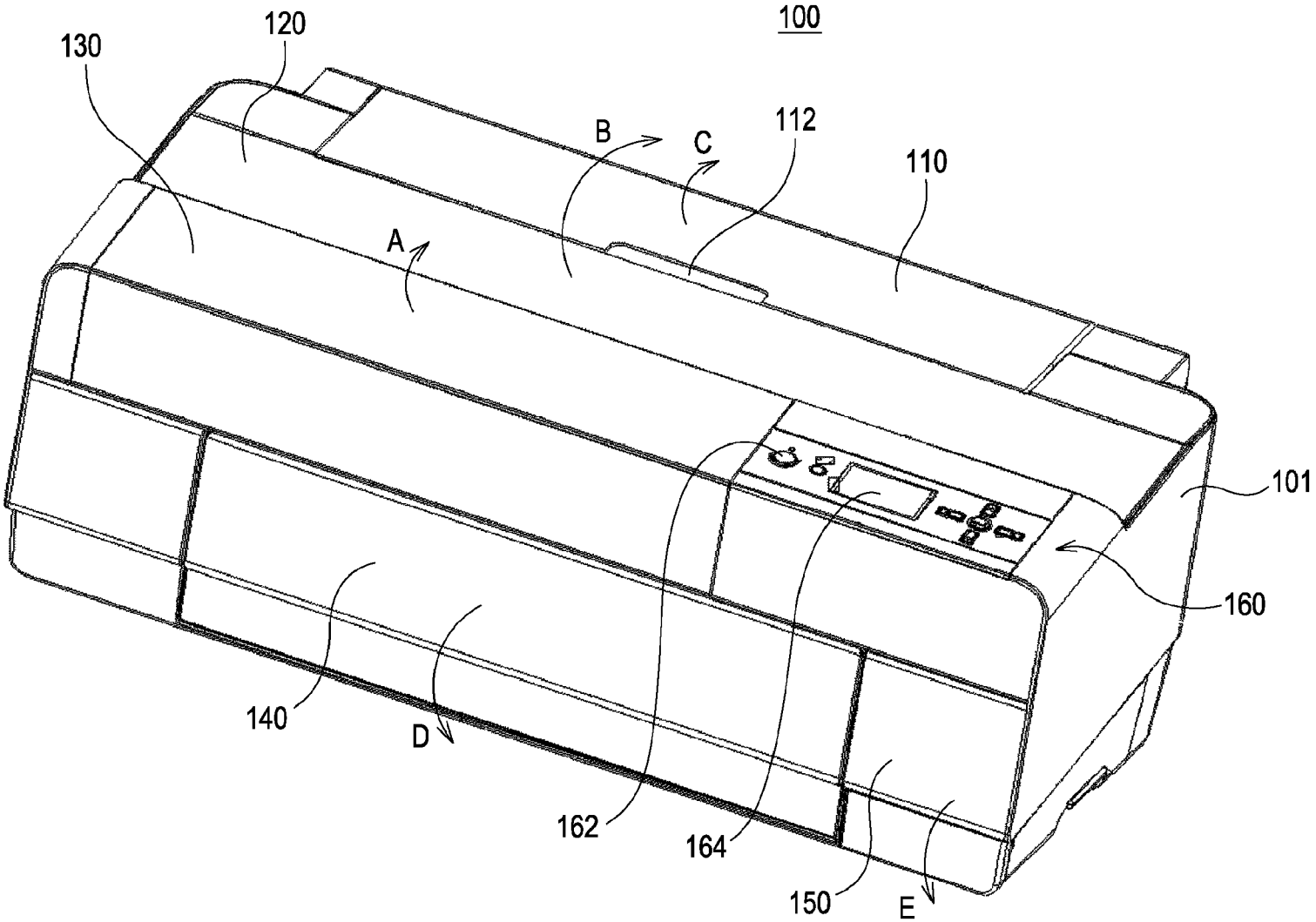
FIG. 1 is a front perspective view that schematically illustrates an example of the general appearance of an ink-jet recording apparatus 100.

FIG. 1 is a front perspective view that schematically illustrates an example of the general appearance of an ink-jet recording apparatus 100 that is provided with a transportation apparatus that constitutes a transportation unit 320 of the ink-jet recording apparatus 100. As illustrated in the drawing, the outer body chassis of the ink-jet recording apparatus 100 is configured as a housing case 101 that has the shape of a substantially rectangular parallelepiped.

On the upper surface of the housing case 101, a transportation target material (paper) feeding unit cover 110, a transportation target material (paper) transport path cover 120, and an ink cartridge holder cover 130 are provided in the order of appearance herein when viewed from the rear end thereof. A user can open the paper feeder cover 110 in a direction shown by an arrow C in the drawing by hooking their finger(s) on a cover-opening slit 112 and then lifting the finger-hooked portion of the paper feeder cover 110. As the user raises the finger-hooked portion thereof, the paper feeder cover 110 hinges with its rear end functioning as a turn axis. When the paper-feeding unit cover 110 is opened, a transportation target material feeding unit 310, which will be described later, appears as its inner component. A user can also open the paper transport path cover 120 and the ink cartridge holder cover 130 in a direction shown in the drawing by arrows B and A, respectively. Each of the paper transport path cover 120 and the ink cartridge holder cover 130 hinges with its rear end functioning as a turn axis. As the paper transport path cover 120 is opened, a paper transport path, which a sheet of recording target medium 250 that is now under recording passes through, appears as its inner component. With such a structure, a user can perform various kinds of troubleshooting and/or maintenance work on the inner transport path. For example, a user can remove a sheet of recording paper that is stuck or jammed on the inner transport path. The ink cartridge holder cover 130 is configured to extend from the upper face of the housing cover 101 to the front face thereof. An inner cartridge holder 230 is exposed when a user opens the ink cartridge holder cover 130. With such a structure, a user can attach, from the front-face side of the ink-jet recording apparatus 100, ink cartridges 232 to the cartridge holder 230 in a detachable manner. They can also remove the ink cartridges 232 from the cartridge holder 230 after opening the ink cartridge holder cover 130.

A transportation target material ejecting unit cover 140 is provided at a position under the ink cartridge holder cover 130 on the front face of the housing case 101. A discarded-ink collection cartridge cover 150 is provided on the right side of the paper-ejecting unit cover 140 on the front face of the housing case 101. A user can open the paper-ejecting unit cover 140 and the discarded-ink collection cartridge cover 150 in a direction shown in the drawing by arrows D and E, respectively. Each of the paper-ejecting unit cover 140 and the discarded-ink collection cartridge cover 150 hinges with its lower end functioning as a turn axis. When a user opens the paper-ejecting unit cover 140, a transportation target material ejection unit 340, which ejects a sheet of recording paper 250 after completion of recording thereon, is exposed as its inner component. On the other hand, a user can replace an old (i.e., filled) discarded-ink collection cartridge 152 with new one after opening the discarded-ink collection cartridge cover 150.

The ink-jet recording apparatus 100 is provided with an operation panel 160, which is provided at the proximal right end of the upper surface of the housing case 101 thereof. The operation panel 160 has manual operation buttons 162 and a liquid crystal display panel 164. The manual operation buttons 162 are used for manipulating the ink-jet recording apparatus 100 directly (i.e., not through data communication). The liquid crystal panel 164 displays the manipulation status and other information. With such a configuration, a user can operate the ink-jet recording apparatus 100 as a standalone device while monitoring its operation/manipulation status displayed on the liquid crystal display panel 164.

Figure 2:
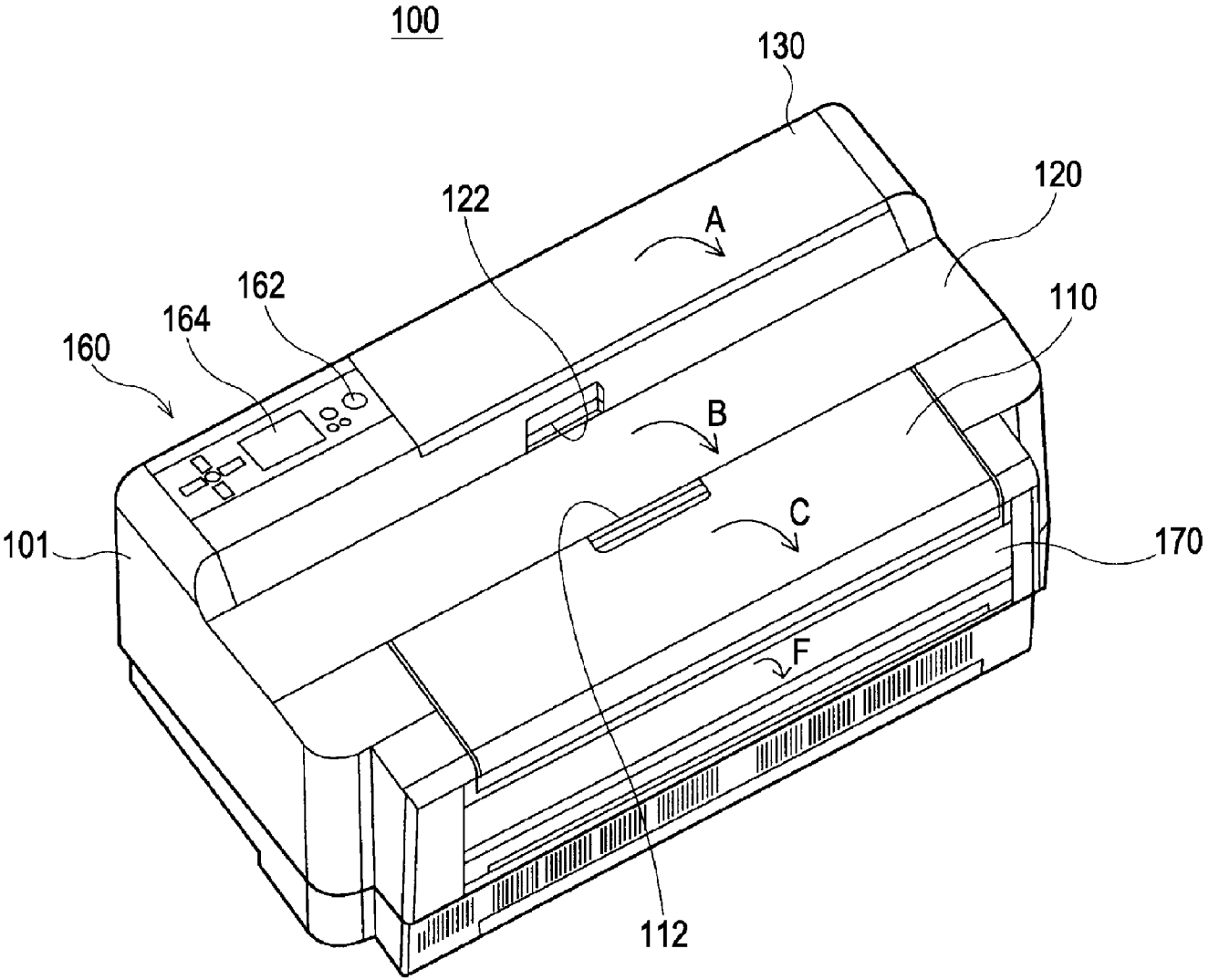
FIG. 2 is a rear perspective view that schematically illustrates an example of the general appearance of the ink-jet recording apparatus 100 illustrated in FIG. 1.

FIG. 2 is a rear perspective view that schematically illustrates an example of the general appearance of the ink-jet recording apparatus 100 illustrated in FIG. 1. As illustrated in the drawing, a cover-opening slit 122 that provides a finger-hold for opening the paper transport path cover 120 is formed in the upper surface of the housing case 101. A manual-feeding paper transport path cover 170 is provided on the rear surface of the housing case 101. A user can open the manual-feeding paper transport path cover 170 in a direction shown by an arrow F in the drawing. The manual-feeding paper transport path cover 170 hinges with its lower end functioning as a turn axis. As a user opens the manual-feeding paper transport path cover 170, an inner path for transporting a sheet of recording paper 254 that is manually fed is exposed. Through the manual-feeding paper transport port, they can insert/feed a sheet of recording paper 254 into the ink-jet recording apparatus 100.

Figure 3:
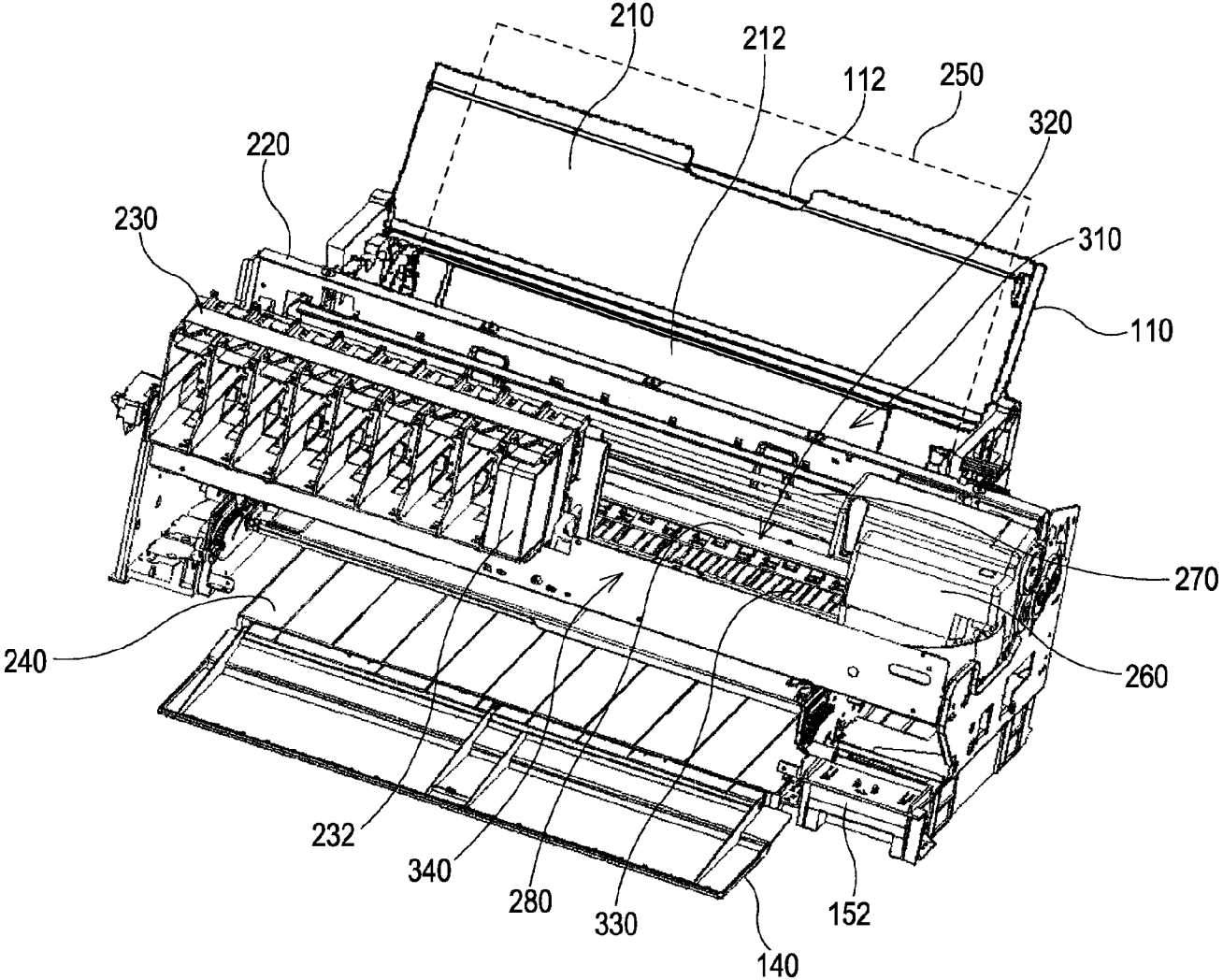
FIG. 3 is a front perspective view that schematically illustrates an example of the configuration of an inner mechanical structure 200 inside the ink-jet recording apparatus 100.

FIG. 3 is a perspective view that schematically illustrates an example of the configuration of an inner mechanical structure 200 that appears when the housing case 101 is removed from the ink-jet recording apparatus 100. FIG. 3 takes the same observation angle/point as that of FIG. 1. As illustrated in the drawing, the inner mechanical structure 200 is provided both at the front side and at the rear side of a frame 220 that extends in a longitudinal direction of the ink-jet recording apparatus 100.

The paper-feeding unit 310, which is exposed when the paper-feeding unit cover 110 is opened, is provided at the back of the frame 220. The paper-feeding unit 310 has a paper support 210, which is formed on the reverse face of the paper-feeding unit cover 110, and a hopper 212 that is provided below the paper support 210. The paper support 210 holds a plurality of sheets of recording paper 250 that are stacked from the backside of the stacked paper 250. While moving forward and backward, the hopper 212 functions to press the uppermost one of the above-mentioned plurality of sheets of recording paper 250 against a paper-feeding roller 312, which will be described later.

In front of the frame 220, a paper transport unit 320, a platen 330, and a paper-ejecting unit 340 are provided. The paper transport unit 320 is provided at a position closest to the frame 220 among these three components, whereas the paper-ejecting unit 340 is provided at a position remotest to the frame 220 among these three components. A carriage 260 is provided above the platen 330. The cartridge holder 230 is provided above the paper-ejecting unit 340.

The cartridge holder 230 is fixed to the front end of the frame 220. A plurality of ink cartridges 232 each of which contains ink is detachably attached to the cartridge holder 230. As a non-limiting exemplary configuration, for example, each one of nine illustrated ink cartridges 232 that are detachably attached to the cartridge holder 230 contains the corresponding one among nine colors of ink, that is, photo black ink, mat black ink, gray ink, yellow ink, cyan ink, light cyan ink, magenta ink, light magenta ink, and red ink. Each of the ink cartridges 232 that are detachably attached to the cartridge holder 230 is in communication with the carriage 260 through a flexible tube that is not shown in the drawing. With such a configuration, each of the ink cartridges 232 supplies ink to a recording head 262 that is provided at the bottom face of the carriage 260.

The carriage 260 reciprocates along a guide axis 280 so as to travel across the entire length (i.e., width) of the platen 330. A timing belt 270 is provided in front of the frame 220. The timing belt 270 is wound around a pair of pulleys (not shown in the drawing) each of which is provided in the proximity of a side end of the frame 220. The timing belt 270 moves horizontally between the pair of pulleys in accordance with the rotation thereof. The carriage 260 is fixed to the timing belt 270. As the timing belt 270 moves, so does the carriage 260.

The discarded-ink collection cartridge 152 that is attached at the front portion of the right end of the frame 220 has an ink absorption member. The ink absorption member absorbs ink that has been discarded by the carriage 260 for the purpose of cleaning its nozzles at a home position that is located on the right side of the platen 330. The amount of ink discarded and accumulated in the discarded-ink collection cartridge 152 increases as the cumulative operation time of the ink-jet recording apparatus becomes longer. A periodical or timely replacement of an old discarded-ink collection cartridge 152 with a new cartridge makes it possible to maintain a high ink absorption capability thereof for a long time period.

Figure 4:
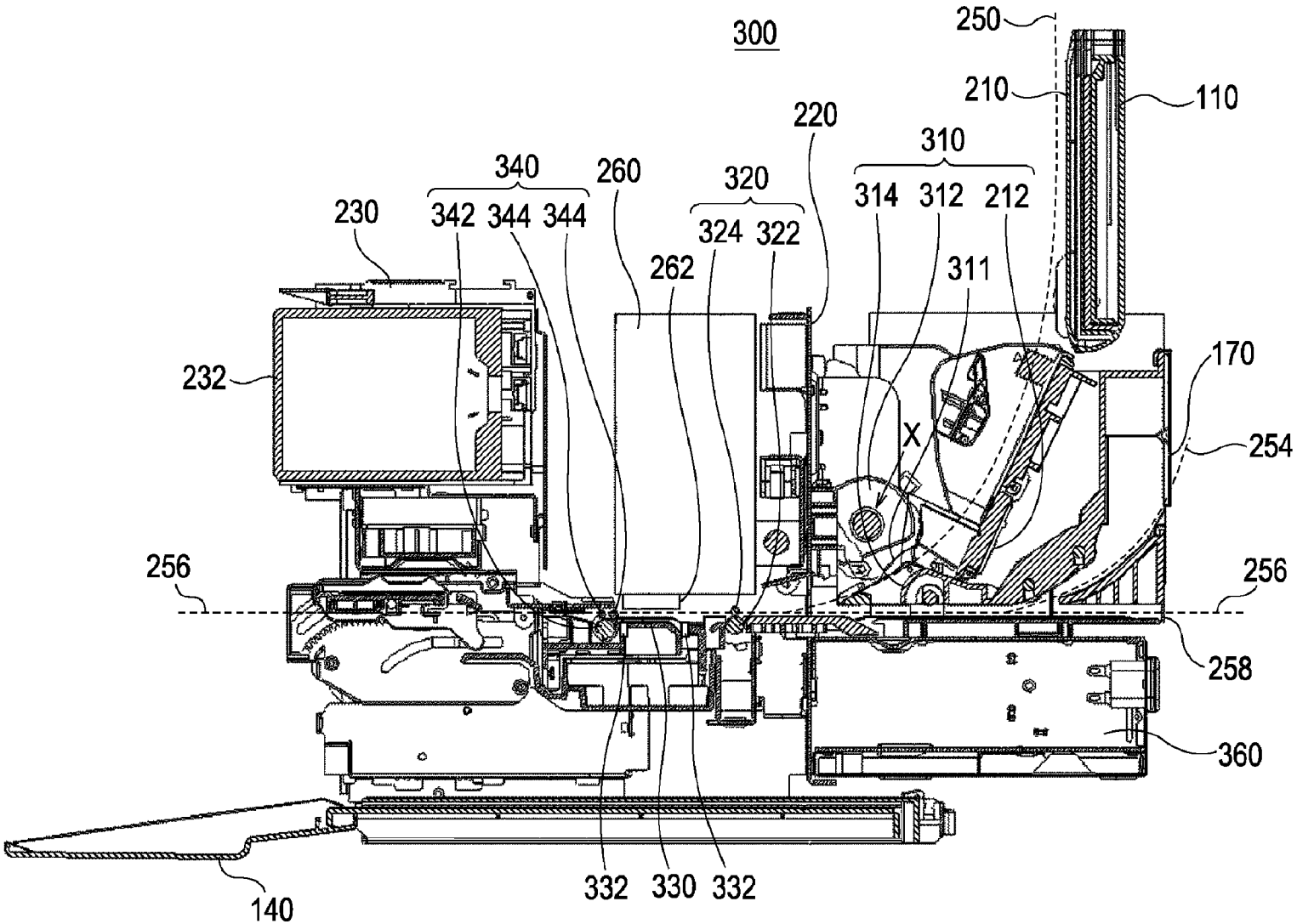
FIG. 4 is a sectional view that schematically illustrates, in the above-described inner mechanical structure 200 of the ink-jet recording apparatus 100, an example of paper transport paths 300 on each route of which a sheet of recording paper 250, recording paper 254, and cardboard paper 256, is transported.

FIG. 4 is a sectional view that schematically illustrates, in the above-described inner mechanical structure 200 of the ink-jet recording apparatus 100, an example of a paper transport path 300 on which a sheet of recording paper 250 is transported. As illustrated in the drawing, the ink-jet recording apparatus 100 has a plurality of paper transport channels (i.e., paths/routes) through which recording paper 250, which is a ink-discharging target medium onto which the recording head 262 mounted on the bottom of the carriage 260 discharges ink drops, can be fed and transported.

The main paper transport channel that is likely to be used most frequently among the plurality of paper transport channels takes/offers the following route; that is, recording paper 250 that has been fed at the paper support 210 goes through the paper-feeding unit 310, the paper transport unit 320, the paper-ejecting unit 340, in the order of appearance herein, and then gets ejected out of the paper-ejecting unit 340. The transport operation of this paper transport channel is explained below. Among a plurality of sheets of recording paper 250 stacked on the paper support, the lower end of the hopper 212 moves forward so as to press the uppermost sheet of the recording paper 250 against the paper-feeding roller 312. A driving motor that is not shown in the drawing drives the paper-feeding roller 312 so as to rotate the paper-feeding roller 312. As the paper-feeding roller 312 rotates, the recording paper 250 that is pressed by the hopper 212 against the paper-feeding roller 312 is drawn downward. Then, the recording paper 250 is pinched between the paper-feeding roller 312 and a retard roller 314. In the course of the above operation, since the lower end of the hopper 212 moves backward, rest of the recording paper 250 is separated from the uppermost sheet of the recording paper 250 by the functioning of the retard roller 314. In addition, paper-returning hook member 311 functions to return, to the paper support 210, other recording paper 250 that is drawn together though not intended to be done so when the paper-feeding target recording paper 250 is drawn downward. Then, upon reaching of the paper-feeding target recording paper 250 that has been fed by the paper-feeding roller 312 to the paper transport unit 320, a contact between the recording paper 250 and the roller contact surface of the paper-feeding roller 312, which has the shape resembling an alphabet D in its cross section, is released. By this means, the paper transport unit 320 takes over the transportation of the recording paper 250 from the D-shaped paper-feeding roller 312.

The paper transport unit 320 is provided with a transport driving roller 322 and a transport driven roller 324. A driving motor that is not shown in the drawing rotates the transport driving roller 322. The transport driven roller 324 is urged against the transport driving roller 322. The transport driven roller 324 follows the rotary movement of the transport driving roller 322. The recording paper 250 that is fed between the transport driving roller 322 and the transport driven roller 324 is pressed against the transport driving roller 322 by the transport driven roller 324. Then, as the transport driving roller 322 rotates, the recording paper 250 is transported onto the platen 330.

While supporting the recording paper 250 that is now under transportation from the reverse side thereof (or, in other words, from a lower side), the platen 330 determines the height of the recording paper 250. The recording head 262 that is mounted on the bottom of the carriage 260 discharges ink drops downward toward the height-determined target recording paper 250. By this means, an ink image is formed on the surface of the recording paper 250. The recording paper 250 with a printed image formed thereon further moves forward. Then, the front edge of the recording paper 250 reaches the paper-ejecting unit 340. A paper position detection unit 332, which detects whether the recording paper 250 is present or not, is provided at an upstream position that is immediately before the platen 330, which is viewed along the transportation direction of the recording paper 250. Another paper position detection unit 332 having the same function as above is also provided at a downstream position that is immediately after the platen 330, which is viewed along the transportation direction of the recording paper 250. With such a configuration, a control unit 360, which will be described later, is capable of making a detection as to whether any recording paper 250 is actually present on the platen 330 or not.

The paper-ejecting unit 340 is provided with an ejection driving roller 342 and a pair of ejection driven rollers 344. A driving motor that is not shown in the drawing rotates the ejection driving roller 342. The ejection driven roller 344 is urged against the ejection driving roller 342. The ejection driven roller 344 follows the rotary movement of the ejection driving roller 342. The recording paper 250 that is fed between the ejection driving roller 342 and the ejection driven roller 344 is pressed against the ejection driving roller 342 by the ejection driven roller 344. Then, as the ejection driving roller 342 rotates, the recording paper 250 is ejected out of the ink-jet recording apparatus 100.

The ink-jet recording apparatus 100 is further provided with the control unit 360, which is responsible for controlling the operations of the ink-jet recording apparatus 100. The control unit 360 is provided at the rear/reverse side of the lower end of the frame 220. The control unit 360 performs control on the basis of a command/instruction that is inputted into the ink-jet recording apparatus 100 via an information processing device or the like that is connected to the ink-jet recording apparatus 100 or on the basis of a command/instruction that is inputted through the operation panel 160 in order to ensure the proper operations of the ink-jet recording apparatus 100. In addition to the above, the control unit 360 further functions as an interface for receiving information on an image that is to be printed. Image information that is received by the control unit 360 may contain, in addition to the image information itself, information on recording quality such as the resolution of an image, the number of colors thereof, though not limited thereto. In addition, it may further contain information on a recording target medium such as paper size and/or material thereof, though not limited thereto.

The ink-jet recording apparatus 100 has a manual-feeding paper transport path that has a feeding port inside the manual-feeding paper transport path cover 170. That is, a user can directly (i.e., manually) feed recording paper 254 just in front of the paper transport unit 320 after opening the manual-feeding paper transport path cover 170 that is provided on the rear face of the housing case 101. With such a configuration, the ink-jet recording apparatus 100 offers another paper transport channel, which is provided separately from the aforementioned main paper transport channel that mechanically feeds the recording paper 250 stacked on the paper support 210. That is, as done on the recording paper 250 that is fed from the paper support 210 automatically, the second paper transport channel makes it possible to perform image recording on the manually-fed recording paper 254, which could be used on a temporarily basis, and then to eject the printed paper on the front side of the ink-jet recording apparatus 100.

In addition, the ink-jet recording apparatus 100 has still another paper transport channel that can be used to perform image recording on a thick type of paper that is not flexible, that is, in this example, a cardboard paper 256 that is not bendable. To use this cardboard paper transport path, a user opens the paper-ejecting unit cover 140 so as to expose an inner cardboard paper transport port, which is not shown in the drawing. Then, the user feed the cardboard paper 256 through the opened port. The cardboard paper transport path, which is configured to be a level horizontal route, passes through a clearance/gap between the recording head 262 and the platen 330 to reach the rear face of the ink-jet recording apparatus 100.

Since the thick cardboard paper 256 has high flexural/bending rigidity, the load of transport increases significantly if it is bent somewhere in the middle of the paper transport path. For this reason, it is necessary to retract the transport driven roller 324 upward when the cardboard paper transport path is in use. When the cardboard paper transport port is opened, the control unit 360 detects that the recording operation of the cardboard paper 256 is started. Upon detection thereof, the control unit 360 reverses the operation of the paper-ejecting unit 340. By this means, the cardboard paper 256 is moved backward until the front edge of the recording surface area of the cardboard paper 256 reaches a point under the recording head 262. Next, the control unit 360 returns the operation of the paper-ejecting unit 340 to its normal rotation so as to transport the cardboard paper 256 forward while recording an image thereon. As described above, the paper transport path 300 of the ink-jet recording apparatus 100 has a plurality of paper transport channels. Depending on the type and/or character of the transportation target medium, for example, the recording paper 250, the recording paper 254, or the cardboard paper 256, a user can select suitable one for performing recording operation.

Figure 5:
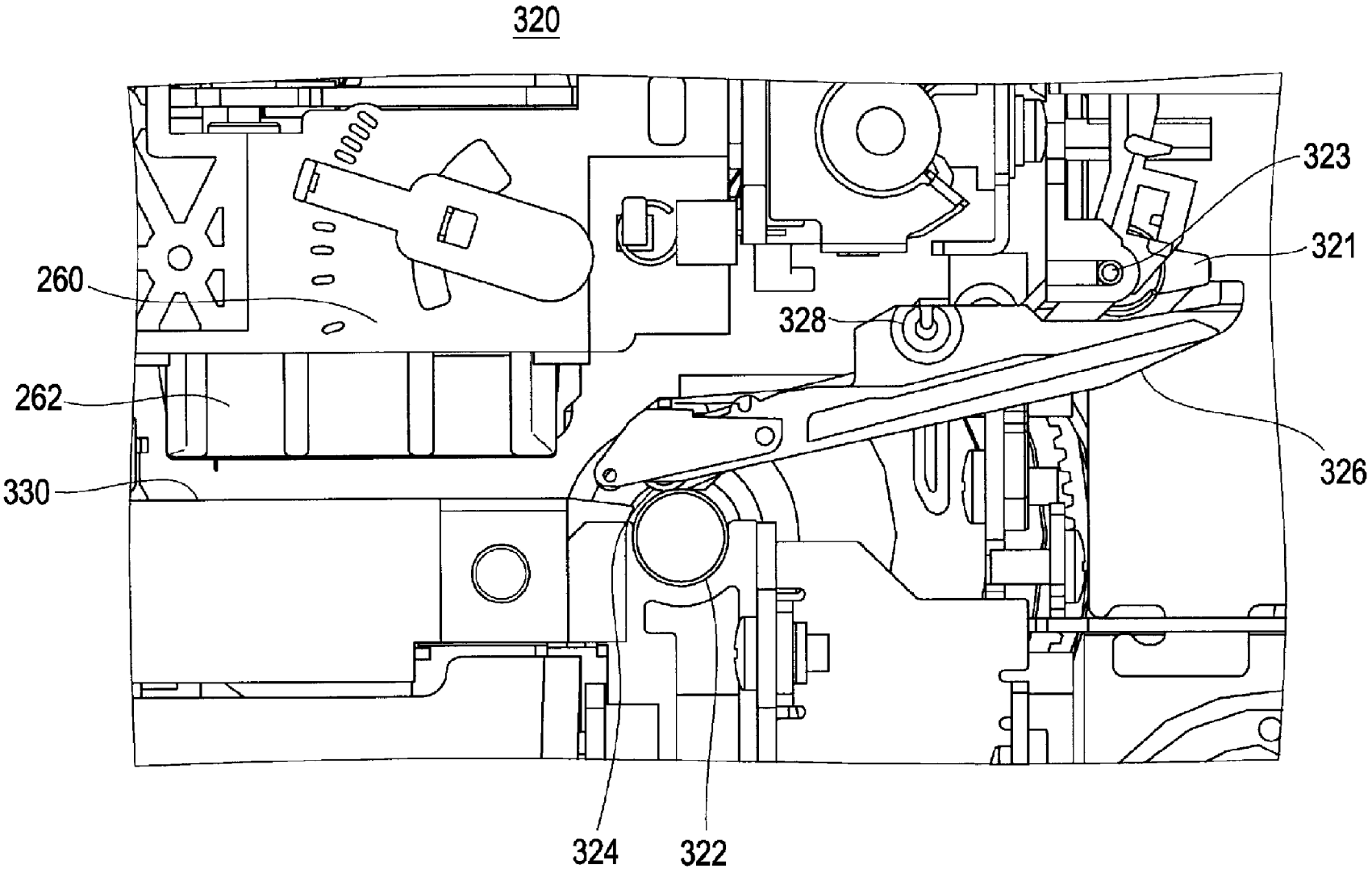
FIG. 5 is an enlarged view that schematically illustrates an example of the configuration of a paper transport unit 320 in the inner mechanical structure 200.

FIG. 5 is an enlarged view that schematically illustrates an example of the configuration of the paper transport unit 320 in the inner mechanical structure 200. As illustrated in the drawing, the transport driven roller 324 is attached to one end of a driven roller holder 326. The transport driven roller 324 is mounted thereto over the transport driving roller 322, both ends of which (322) are supported by the frame 220, so that the transport driven roller 324 applies a contact force (i.e., pressing force) against the transport driving roller 322 from the above. The driven roller holder 326 is supported by the frame 220 in such a manner that it can move in a rotating direction (i.e., draw/trace an arc) around a turn axis 328. The other end of the driven roller holder 326 is raised/lowered by a cam 321 that turns around a camshaft 323. The cam 321 and the other end of the driven roller holder 326 are provided at the rear-face side of the frame 220. As the cam 321 raises/lowers the other end of the driven roller holder 326, it is possible to lower/raise the transport driven roller 324 that is attached to the above-described one end (i.e., opposite to "cam end") of the driven roller holder 326.

Figure 6:
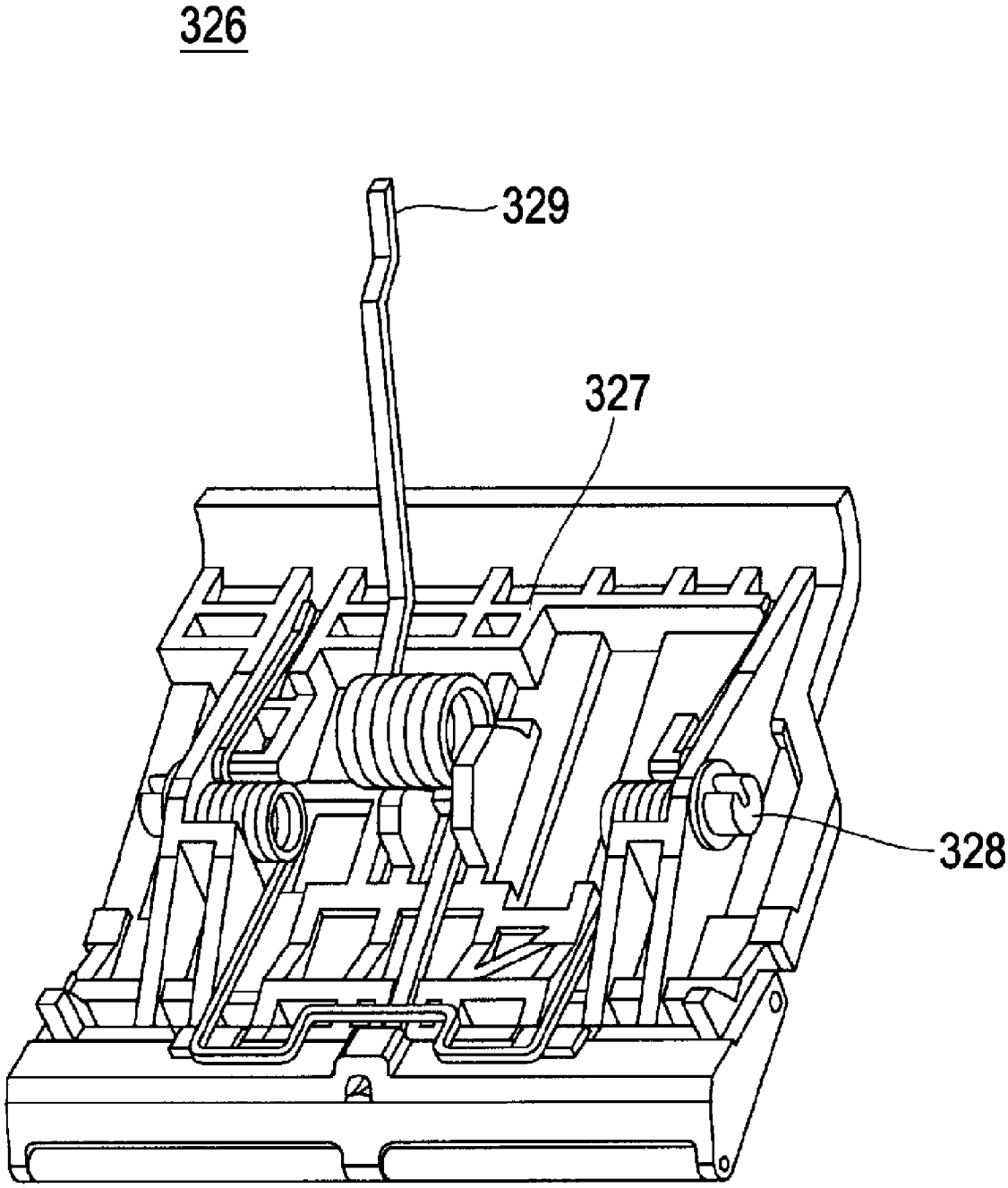
FIG. 6 is a perspective view that schematically illustrates an example of the configuration of one of a plurality of driven roller holders 326 that are provided in the paper transport unit 320 illustrated in FIG. 5.

FIG. 6 is a perspective view that schematically illustrates an example of the configuration of one of a plurality of the driven roller holders 326 that are provided in the paper transport unit 320 illustrated in FIG. 5. As illustrated in the drawing, the driven roller holder 326 is configured as a flat-shaped resin component having an integrally molded body as a whole. The turn axis 328 is also formed to constitute a part of the integrally molded body The turn axis 328 is formed to protrude at middle side (left/right) regions between a front region and a back region thereof. The driven roller holder 326 supports, substantially at the front end thereof, a pair of the transport driven rollers 324.

Each of the driven roller holders 326 has a spring 329 that stands in the center region of the driven roller holder 326. As described later, when the driven roller holder 326 is attached to the frame 220, the spring 329 is fixed to the frame 220 with its rear end being set in a standing position. The spring 329 applies an urging force to the driven roller holder 326 in a direction to lower the pair of the transport driven rollers 324. On the other hand, the front end of the spring 329 contacts the central region, or in the proximity thereof, of the front end of the driven roller holder 326.

The driven roller holder 326 has many ribs 327 formed as a part of integrally molded body to have high flexural/bending rigidity. Although the driven roller holder 326 has good flexural/bending stiffness, it is subjected to mechanical stress because, as has already been described above, on one hand, the cam 321 that raises the transport driven roller 324 applies a contact/pressing force to the rear end of the driven roller holder 326, while on the other hand, the spring 329 applies an urging force to the front end thereof. For this reason, plastic deformation could occur on the driven roller holder 326 if the transport driven roller 324 continues to be raised for a long time period.

Figure 7:
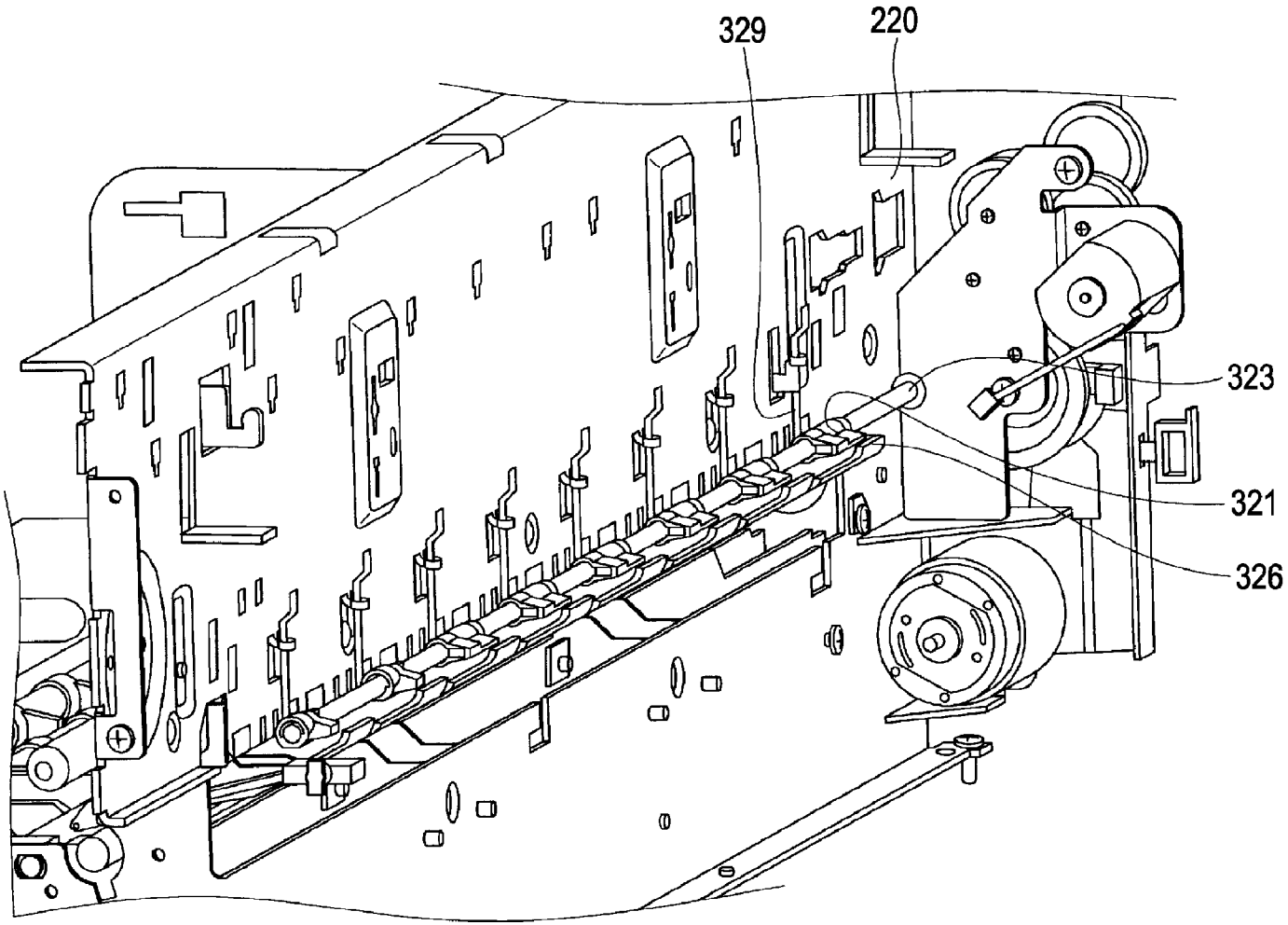
FIG. 7 is a diagram that schematically illustrates an example of the paper transport unit 320, including its peripheral components, which is viewed from the rear side of the frame 220.

FIG. 7 is a diagram that schematically illustrates an example of the driven roller holders 326 and their peripheral components illustrated in FIG. 5, which are viewed from the rear side of the frame 220. As illustrated in the drawing, each rear end of the driven roller holder 326 is protruded through the rear face of the frame 220. A plurality of the driven roller holders 326, the number of which may be determined arbitrarily depending on the length of the transport driving roller 322, are provided. A cam 321 is provided for each of the plurality of the driven roller holders 326. One end of the spring 329 is fixed to the frame 220 for each of the driven roller holders 326.

The plurality of cams 321 is supported by a camshaft 323 above the driven roller holders 326 at the rear side of the frame 220. As the camshaft 323 turns, so does each of the cams 321. As each of the cams 321 rotates, the rear end of the corresponding driven roller holder 326 is lowered. When the cams 321 lower the rear ends of the driven roller holders 326, the transport driven rollers 324 that are attached to the opposite end (i.e., front end) thereof are raised. On the other hand, since each of the springs 329 applies an urging force to the corresponding driven roller holder 326, the rear ends of the driven roller holders 326 are raised when the cams 321 are oriented in a direction illustrated in the drawing. Since the rear ends of the driven roller holders 326 are raised, the transport driven rollers 324 are lowered. The lowered transport driven rollers 324 contact the transport driving roller 322. In other words, it is possible to check whether the transport driven rollers 324 are in a raised non-contact position or not by checking the orientation of the cams 321.

Figure 8:
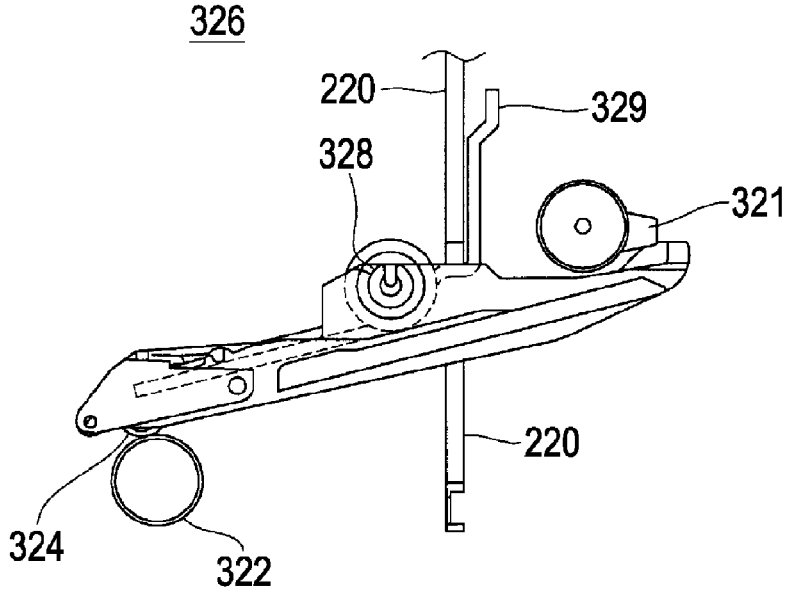
FIG. 8 is a diagram that schematically illustrates the contact state of the driven roller holder 326, where a pair of the transport driven rollers 324 is lowered to its contact position.

FIG. 8 is a diagram that schematically illustrates the "contact state" of the driven roller holder 326 illustrated in FIGS. 6 and 7, where a pair of the transport driven rollers 324 is lowered to its contact position. As illustrated in the drawing, the front end (i.e., the left end in the drawing) of the driven roller holder 326 is lowered so that the transport driven rollers 324 are in contact with the transport driving roller 322. Since the spring 329 is fixed to the rear face of the frame 220 with its rear end being set in a standing position, the front end of the driven roller holder 326 is urged downward by the spring 329. However, the urging force of the spring 329 is not exerted on the driven roller holder 326 because the spring 329 applies its pressing force right on the transport driven rollers 324, which contact the transport driving roller 322.

Figure 9:
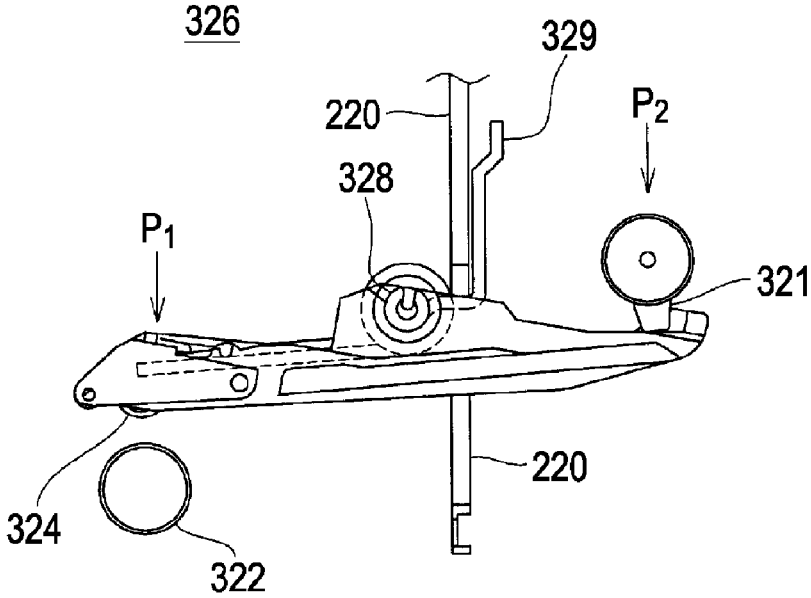
FIG. 9 is a diagram that schematically illustrates the non-contact state of the -driven roller holder 326, where the pair of the transport driven rollers 324 is raised to its non-contact position.

FIG. 9 is a diagram that schematically illustrates the "non-contact state" of the driven roller holder 326, where a pair of the transport driven rollers 324 is raised to its non-contact position. As illustrated in the drawing, in order to move the transport driven roller 324 to its non-contact position, the cam 321 applies a pressing force of $P_2$ onto the rear end, or in the neighborhood thereof, of the driven roller holder 326 downward so as to turn the driven roller holder 326. As the driven roller holder 326 turns, the front end thereof is raised so that the transport driven roller 324 moves apart from the transport driving roller 322. While the rear end of the driven roller holder 326 is pressed down, the spring 329 continues to apply an urging force Pi onto the front end thereof, intensively. The driven roller holder 326 is supported indirectly from the frame 220 at its approximately center by means of the turn axis 328. As a result of such static mechanical stress that is applied/exerted onto the driven roller holder 326 for a long time period, a creep strain could occur thereon, which is made of resin. Finally, the creep deformation could eventually cause the front end of the driven roller holder 326 to sag.

Figure 10:
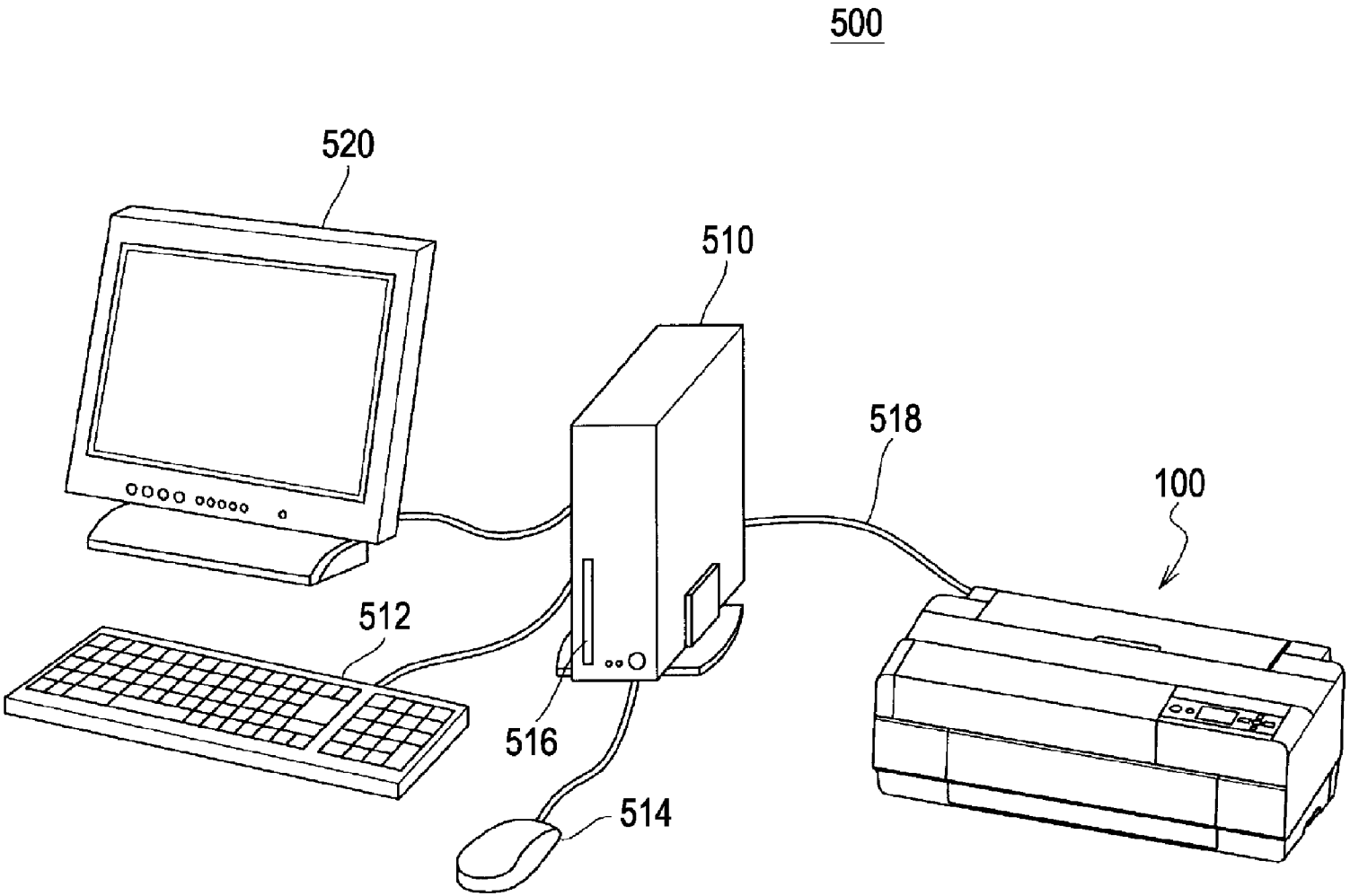
FIG. 10 is a diagram that schematically illustrates an example of the configuration of a system 500 that is configured to operate the ink-jet recording apparatus 100.

FIG. 10 is a diagram that schematically illustrates an example of the configuration of a system 500 that is configured to operate the ink-jet recording apparatus 100 described above. As illustrated in the drawing, in the system 500, the ink-jet recording apparatus 100 is connected to an information processing apparatus 510, which serves as a host apparatus, via a cable 518 that is connected to the control unit 360 of the ink-jet recording apparatus 100. The information processing apparatus 510 is provided with a keyboard 512 and a computer mouse 514, which constitute input means for accepting instructions or the like from a user, and a display apparatus 520 that displays images to the user.

The information processing apparatus 510 is further provided with a disc drive 516 for reading/writing information from/into a storage medium and with a telecommunication line (not shown in the drawing) for performing data communication with an external communication device, server, or the like. With such a configuration, in addition to image information that is created by the information processing apparatus 510 by itself, the information processing apparatus 510 is able to acquire image information that is to be recorded (i.e., printed out) by the ink-jet recording apparatus 100 from a storage medium that is inserted in the disc drive 516, via the communication line, or the like. In addition, the information processing apparatus 510 may read/download, and then install, a program for controlling the ink-jet recording apparatus 100 from an external source.

Figure 11:
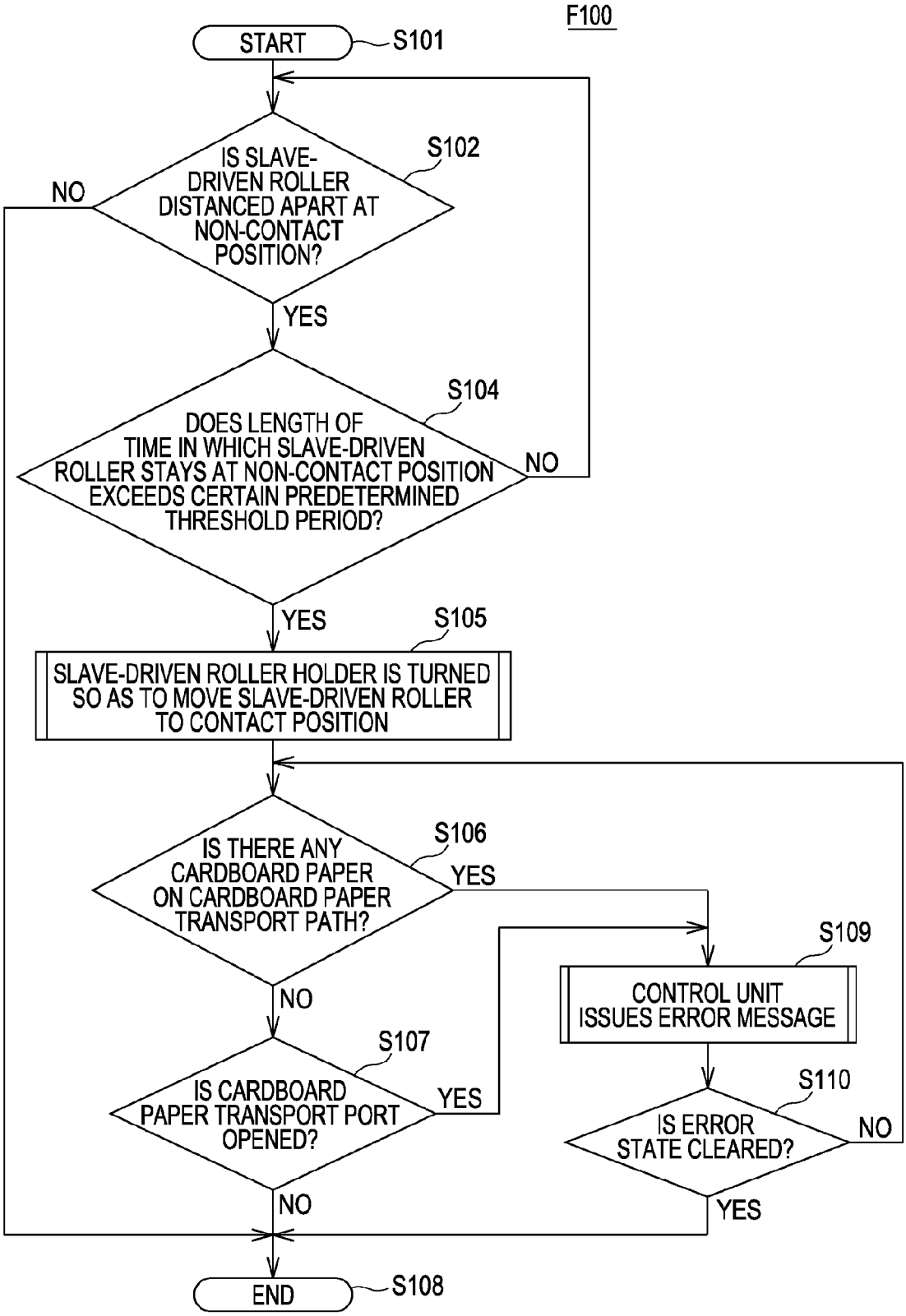
FIG. 11 is a flowchart F100 that illustrates an example of the control procedures executed by the control unit 360.

FIG. 11 is a flowchart F100 that illustrates an example of the control flow applied by the control unit 360 to the cam 321. As illustrated in the drawing, when a cardboard paper transport port is opened so as to enter the ink-jet recording apparatus 100 into a standby state in which the ink-jet recording apparatus 100 waits for the initiation of the recording operation on the target cardboard paper 256, the control unit 360 starts the following series of control operations performed on the paper transport unit 320 (step S101).

Upon initiation of the series of control operations, as a first step thereof, the control unit 360 makes a judgment as to whether the transport driven roller 324 is currently distanced, that is, raised, at a position apart from the transport driving roller 322 or not (referring to such a non-contact state, the term "non-contact position" is used in the following description as well as the appended claims) (step S102). If it is judged that the transport driven roller 324 is currently in a lowered position to be in contact with the transport driving roller 322 (referring to such a contact state, the term "contact position" is used in the following description as well as the appended claims) (step S102: NO), the control unit 360 ends the controlling of the paper transport unit 320 because there is no risk of the plastic deformation of the driven roller holder 326 when it is in the contact state (step S108).

On the other hand, if it is judged that the transport driven roller 324 is currently in the non-contact position (step S102: YES), the control unit 360 checks the length of time period (i.e., duration) of the non-contact state in which the transport driven roller 324 stays (i.e., continues to be) at the non-contact position. Then, the control unit 360 further makes a judgment as to whether the length of time period in which the transport driven roller 324 continues to be at the non-contact position exceeds a certain predetermined threshold period or not (step S104). If it is judged that the length of time period in which the transport driven roller 324 continues to be at the non-contact position is not more than the certain predetermined threshold period (step S104: NO), the process returns to the preceding step S102. Then, the above-described judgment process is repeated until the length of time period in which the transport driven roller 324 continues to be at the non-contact position exceeds the certain predetermined threshold time period.

On the other hand, if it is judged that the length of time period in which the transport driven roller 324 continues to be at the non-contact position exceeds the certain predetermined threshold period (step S104: YES), the control unit 360 causes the cam 321 to turn. As a result thereof, the driven roller holder 326 is turned so as to move the transport driven roller 324 to the contact position (step S105). By this means, it is possible to prevent the occurrence of a creep deformation on/of the stress-applied the driven roller holder 326 by releasing it.

Next, after moving the transport driven roller 324 to the contact position, the control unit 360 makes a judgment as to whether there is any cardboard paper 256 on the cardboard paper transport path or not (step S106). If it is judged that a cardboard paper 256 is present on the cardboard paper transport path (step S106: YES), the control unit 360 issues an error message so as to alert the user (step S109). When the user removes the detected cardboard paper 256 in response to the alert error message, the control unit 360 confirms the clearance of the error state (step S110: YES). Then, the control unit 360 ends the series of control processing (step S108). On the other hand, if the outstanding error state is not cleared (step S110: NO), the control unit 360 returns the process to the previous step S106.

If it is judged that there is no cardboard paper 256 on the cardboard paper transport path (step S106: NO), the control unit 360 further checks whether the cardboard paper transport port is opened or not (step S107). If it is judged that the cardboard paper transport port is closed (step S107: NO), the control unit 360 ends the positional control of the transport driven roller 324 because, if it is closed, it is in the same state as in a stand-by mode prior to usual recording operations, that is, normal recording in which the cardboard paper transport path is not used. On the other hand, if it is judged that the cardboard paper transport port is opened (step S107: YES), the control unit 360 issues an error message so as to alert the user to either close the cardboard paper transport port or move the transport driven roller 324 to the non-contact position (step S109). Then, the control unit 360 waits for the user to clear the error state in response to the issued alert error message (step S110).

As explained above, the ink-jet recording apparatus 100 according to an exemplary embodiment of the invention is configured to lower (a pair of) the transport driven roller(s) 324 so as to make it contact the transport driving roller 322 if the length of time period in which the transport driven roller 324 continues to be raised against the urging/pressing force of the spring 329 applied/exerted downward exceeds a certain predetermined threshold time period. With such a configuration, the invention makes it possible to effectively prevent the occurrence of plastic deformation of the driven roller holder 326 due to the mechanical stress applied by the spring 329. Since it is not necessary to anticipate the plastic deformation of the driven roller holder 326, it is not necessary to set a gap between the transport driven roller 324 and the transport driving roller 322 at a large distance. Accordingly, it is not necessary to increase the size of the ink-jet recording apparatus 100 just for the purpose of maintaining the gap between the transport driven roller 324 and the transport driving roller 322. In addition, it is also not necessary to disadvantageously increase the mechanical strength of the driven roller holder 326 by means of costly material or any other similar means. Thus, the invention offers a cost advantage when manufacturing the ink-jet recording apparatus 100.

Although the present invention is described while explaining the exemplary embodiments thereof, the technical scope of the invention is in no case limited to the explicit and implicit description of the above embodiments of the invention. It is clear and obvious for a person skilled in the art that the above embodiments of the invention may be subjected to various alterations, adaptations, modifications, or improvements thereof. From the recitation of the appended claims, it is clear and obvious that such an altered, adapted, modified, or improved mode is also encompassed by the technical scope of the invention.

What is claimed is:

1. A transportation apparatus for transporting a transportation target medium in a predetermined transportation direction, the transportation target medium transportation apparatus comprising:

a transport driving roller that is operated rotationally;

a transport driven roller that is urged against the transport driving roller and follows the rotary movement of the transport driving roller; and a control section that controls the movement of the transport driven roller between a contact position at which the transport driven roller is in contact with the transport driving roller and a non-contact position at which the transport driven roller is not in contact with the transport driving roller, wherein the control section moves the transport driven roller to the non-contact position at which the transport driven roller is not in contact with the transport driving roller when the thickness of the transportation target medium is at least a predetermined value, and then moves the transport driven roller to the contact position at which the transport driven roller is in contact with the transport driving roller when the length of time period in which the transport driven roller continues to be at the non-contact position exceeds a predetermined time period, and wherein the control section issues a message for notifying to a user that, in a case where the transport driven roller has been moved to the contact position at which the transport driven roller is in contact with the transport driving roller when the length of time period in which the transport driven roller continues to be at the non-contact position exceeds the predetermined time period, the moving of the transport driven roller to the contact position has been completed; and the control section causes the transport driven roller to stay at the contact position till the reception of the issued message by the user is confirmed.

2. The transportation target medium transportation apparatus according to claim 1, wherein the control section makes a detection as to whether a transportation target medium is present between the transport driving roller and the transport driven roller or not, and issues a message so as to alert the user to remove, if present, the transportation target medium therefrom.

3. The transportation target medium transportation apparatus according to claim 1, wherein the control section moves the transport driven roller to a position corresponding to a recording target medium that is most likely to be fed in the next operation in a case where the transport driven roller has been moved to the contact position at which the transport driven roller is in contact with the transport driving roller when the length of time period in which the transport driven roller continues to be at the non-contact position exceeds the predetermined time period and further in a case where it is detected that no transportation target medium is present between the transport driving roller and the transport driven roller.

4. A recording apparatus having a recording head for forming an image on the surface of a recording target medium, the recording apparatus being provided with the transportation target medium transportation apparatus according to claim 1.

5. A control method for controlling a transportation apparatus for transporting a transportation target medium in a predetermined transportation direction, the transportation target medium transportation apparatus having a transport driving roller that is operated rotationally and further having a transport driven roller that is urged against the transport driving roller and follows the rotary movement of the transport driving roller, the transportation target medium transportation apparatus being configured so as to be able to control the movement of the transport driven roller between a contact position at which the transport driven roller is in contact with the transport driving roller and a non-contact position at which the transport driven roller is not in contact with the transport driving roller, the control method for controlling the transportation target medium transportation apparatus comprising:

moving the transport driven roller to the non-contact position at which the transport driven roller is not in contact with the transport driving roller when the thickness of the transportation target medium is at least a predetermined value; and moving the transport driven roller to the contact position at which the transport driven roller is in contact with the transport driving roller when the length of time period in which the transport driven roller continues to be at the non-contact position exceeds a predetermined time period, wherein the control section issues a message for notifying to a user that, in a case where the transport driven roller has been moved to the contact position at which the transport driven roller is in contact with the transport driving roller when the length of time period in which the transport driven roller continues to be at the non-contact position exceeds the predetermined time period, the moving of the transport driven roller to the contact position has been completed; and the control section causes the transport driven roller to stay at the contact position till the reception of the issued message by the user is confirmed.

6. A transportation apparatus for transporting a transportation target medium in a predetermined transportation direction, the transportation target medium transportation apparatus comprising:

a transport driving roller that is operated rotationally;

a transport driven roller that is urged against the transport driving roller and follows the rotary movement of the transport driving roller; and a control section that selectively controls the movement of the transport driven roller between a contact position at which the transport driven roller is in contact with the transport driving roller and a non-contact position at which the transport driven roller is not in contact with the transport driving roller depending on the thickness of the transportation target medium, wherein the control section moves the transport driven roller to the contact position at which the transport driven roller is in contact with the transport driving roller when the length of time period in which the transport driven roller continues to be at the non-contact position exceeds a predetermined time period, and wherein the control section issues a message for notifying to a user that, in a case where the transport driven roller has been moved to the contact position at which the transport driven roller is in contact with the transport driving roller when the length of time period in which the transport driven roller continues to be at the non-contact position exceeds the predetermined time period, the moving of the transport driven roller to the contact position has been completed; and the control section causes the transport driven roller to stay at the contact position till the reception of the issued message by the user is confirmed.

* * * * *